US007813672B2

(12) United States Patent
Shiraki et al.

(10) Patent No.: US 7,813,672 B2
(45) Date of Patent: Oct. 12, 2010

(54) IMAGE FORMING APPARATUS AND DEVELOPER CARTRIDGE

(75) Inventors: Masatoshi Shiraki, Nisshin (JP); Hiroshi Igarashi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 472 days.

(21) Appl. No.: 11/688,321

(22) Filed: Mar. 20, 2007

(65) Prior Publication Data

US 2007/0217817 A1 Sep. 20, 2007

(30) Foreign Application Priority Data

Mar. 20, 2006 (JP) ..... 2006-077270

(51) Int. Cl.
*G03G 15/04* (2006.01)

(52) U.S. Cl. ..... 399/119

(58) Field of Classification Search ..... 399/119, 399/113, 229

See application file for complete search history.

(56) References Cited

U.S. PATENT DOCUMENTS 5,386,286 A * 1/1995 Kinouchi et al. ..... 399/228
5,881,341 A 3/1999 Kumar et al.
5,943,529 A * 8/1999 Miyabe et al. ..... 399/111
6,246,841 B1 * 6/2001 Merrifield et al. ..... 399/27
6,377,765 B1 * 4/2002 Shishido et al. ..... 399/113
6,708,011 B2 3/2004 Nomura et al.
2004/0062566 A1 * 4/2004 Kato et al. ..... 399/110
2006/0222403 A1 * 10/2006 Takamatsu ..... 399/116
2006/0251443 A1 * 11/2006 Abe et al. ..... 399/90

FOREIGN PATENT DOCUMENTS

JP 2003-015378 1/2003

OTHER PUBLICATIONS

Office Action received for Chinese Application No. 2007100893054 mailed Jul. 4, 2008.

* cited by examiner

*Primary Examiner*—David M Gray
*Assistant Examiner*—Rodney Bonnette
(74) *Attorney, Agent, or Firm*—Banner & Witcoff, Ltd

(57) ABSTRACT

An elastic member for urging a developer carrier in the direction of an image carrier is located in a casing of a developer cartridge. Since the elastic member will be new whenever the developer cartridge is replaced, an urging force of the elastic member will not deteriorate over time. Thus, a proper pressing state of the developer carrier on the image carrier is maintained. Thus, the amount of toner supplied from the developer carrier to the image carrier is stable. Thereby, a picture of high quality can be formed continuously without poor development by poor pressure between the developer carrier and the image carrier.

8 Claims, 14 Drawing Sheets

IMAGE FORMING APPARATUS AND DEVELOPER CARTRIDGE

RELATED APPLICATION INFORMATION

This application claims priority to Japanese Application number 2006-077270 filed Mar. 20, 2006, whose contents are expressly incorporated herein by reference.

FIELD

Aspects of the present invention relate to an image forming apparatus such as a laser printer and a developer cartridge installed therein.

DESCRIPTION OF RELATED ART

A known color laser printer includes photosensitive drum cartridges each including an photosensitive drum, where the photosensitive drum cartridges correspond to one of different colors. The photosensitive drum cartridge is detachably installed in the laser printer. A developer cartridge corresponding to each color is detachably installed in the photosensitive drum. The developer cartridge includes a developer roller to supply toner in the photosensitive drum. The developer roller contacts the photosensitive drum with a proper pressing force so that the toner is transferred evenly from the developer roller to the photosensitive drum. The laser printer includes an elastic member such as springs, and the elastic member acts on the developer cartridge to press the developer roller to the photosensitive drum. However, the elasticity of the elastic member gradually decreases as the elastic member deteriorates. Since the pressing force of the developer roller on the photosensitive drum decreases as the elasticity of the elastic member decreases, a desired amount of toner may not be conveyed to the photosensitive drum.

SUMMARY

Aspects of the present invention relate to providing an adequate pressing force to press a developer roller and an image carrier together.

DETAILED DESCRIPTION

Aspects of the invention relate to improving how a developer carrier and an image carrier are pressed against each other.

It is noted that various connections are set forth between elements in the following description. It is noted that these connections in general and, unless specified otherwise, may be direct or indirect and that this specification is not intended to be limiting in this respect.

For purposes herein, aspects of the invention are shown in relation to an image carrier and developer carrier. In various aspects, the image carrier may include a photosensitive drum, photosensitive belt, or the combination of one of a photosensitive drum or belt and an intermediate transfer drum or belt. Further, the developer carrier may include a developer roller or other systems for conveying developer to the image carrier.

Embodiments of One or More Aspects of the Invention

1. General Configuration of Color Laser Printer

Figure 1:
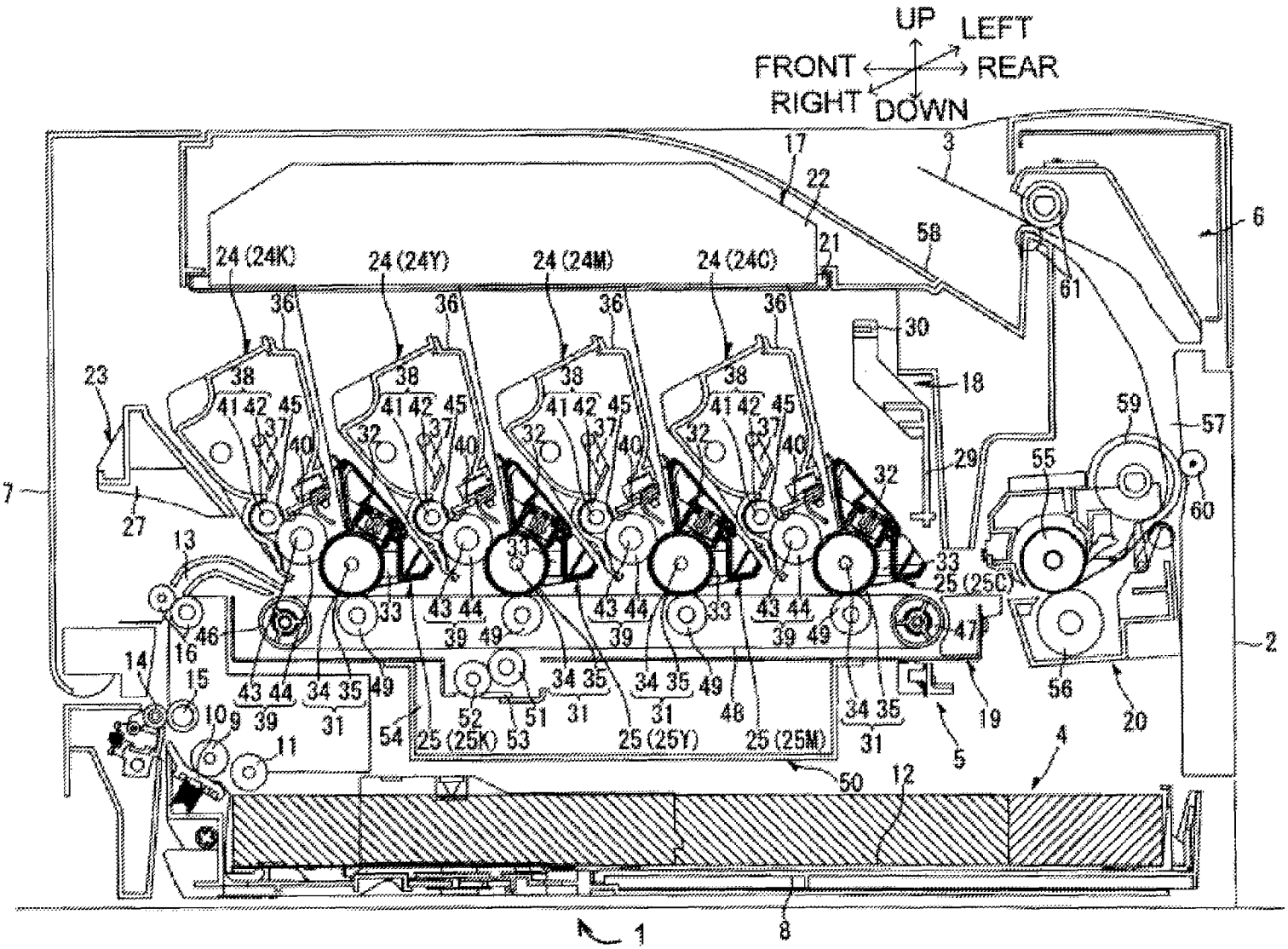
FIG. 1 represents a sectional view of a color laser printer in accordance with aspects of the present invention.

As shown in FIG. 1, in a color laser printer 1, multiple parallel subunits 25 are located horizontally in a box-shaped housing 2. A paper feeder portion 4 for feeding paper 3, an image forming portion 5 for forming an image on the paper 3, and a paper ejection portion 6 for ejecting the paper 3 are provided in the housing 2.

(1) Housing

A front cover 7 is provided on the sidewall of the housing 2 to allow one to open or close the housing 2. The front cover 7 can pivot around a lower-edge portion of the front cover 7. When the front cover 7 is opened, a process unit 18 becomes removable from the housing 2 by sliding the process unit 18 in the longitudinal direction.

Note that in the description below, the side where the front cover 7 is installed (the left side of FIG. 1), is referred to as the "front", while the right side of FIG. 1 is referred to as the "back". Furthermore, the right and the left are determined by viewing this color laser printer 1 from the front. In addition, as for a drum unit 23 and a developer cartridge 24, except as otherwise noted, back and forward, right and left, and up and down are determined by the way they are installed on the housing 2.

(2) Paper Feeder Portion

The paper feeder portion 4 may be located in the bottom part of the housing 2. The paper feeder portion 4 includes a paper tray 8 for accommodating the paper 3, a separation roller 9 and a separation pad 10, which are located in the upper front end of the paper tray 8, and a paper feeder roller 11, which is located behind the separation roller 9.

A paper press plate 12 may be provided in the paper tray 8. The paper 3 is stacked on the paper press plate 12. The top-most paper 3 is pressed via the paper feeder roller 11. When the paper feeder roller 11 is rotated, the top-most paper 3 is fed between the separation roller 9 and the separation pad 10. The paper 3 is held between the separation roller 9 and the separation pad 10 and is conveyed in a feed path 13.

In the middle of the feed path 13, a paper powder-removing roller 14 and a pinch roller 15 and a pair of registration rollers 16 may be provided above and to the front of the separation roller 9. The paper 3 conveyed in the feed path 13 passes between the paper powder-removing roller 14 and the pinch roller 15. When the paper 3 passes through, paper powder adhered thereon is removed. Then the paper 3 is conveyed to a transfer belt 48 via the registration roller 16.

(3) Image Forming Portion

The image forming portion 5 includes an exposure unit 17, a process unit 18, transfer mechanism 19, and fixing unit 20.

(3-1) Exposure Unit

The exposure unit 17 may be located in the upper portion of the housing 2. The exposure unit 17 includes a support plate 21, and casing 22 containing an optical element such as a laser emission portion or a polygon mirror.

In the exposure unit 17, a laser beam corresponding to each color (black, yellow, magenta, and cyan) of an image data is emitted from a laser emission portion. The laser beam is scanned by the polygon mirror and is illuminated on the surface of photosensitive drum 31.

(3-2) Process Unit

A process unit 18 may include a drum unit 23, as an example of an photosensitive drum cartridge, and four developer cartridges 24 corresponding to each color of black, yellow, magenta, and cyan.

(3-2-1) Drum Unit

Figure 2:
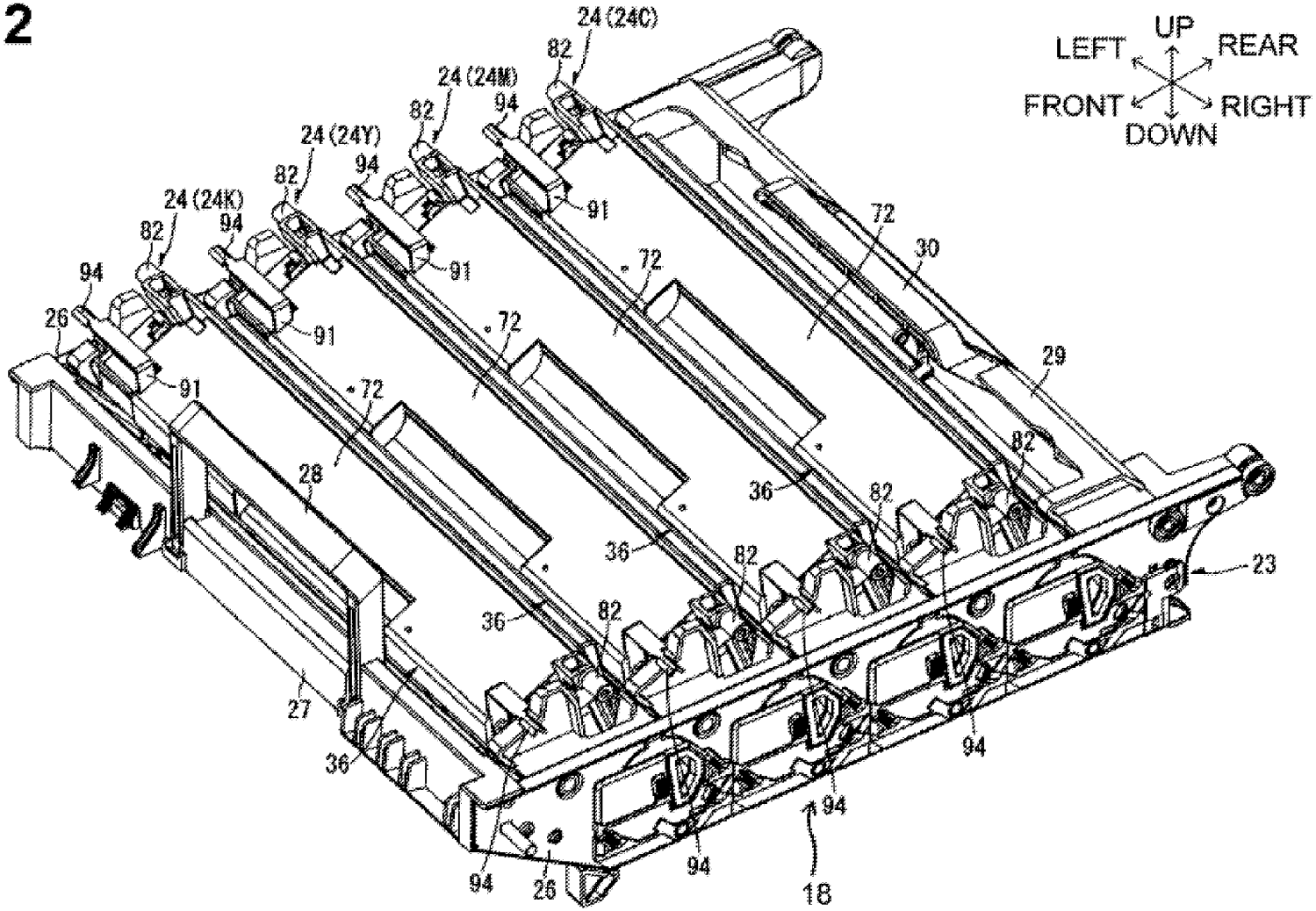
FIG. 2 represents a perspective view of the process unit represented in FIG. 1 in accordance with aspects of the present invention.

As shown in FIG. 1 and FIG. 2, the drum unit 23 includes a pair of sidewalls 26.

Four subunits 25 corresponding to each color are included between the pair of sidewalls 26. In FIG. 2, only the right sidewall 26 is illustrated. A front beam 27 is fixed on each front-edge portion of the sidewalls 26. A front handle 28 is attached to the front beam 27. A rear beam 29 is fixed on each back-edge portion of the sidewalls 26. A rear handle 30 is attached to the rear beam 29. The front beam 27 and the rear beam 29 define the distance between the pair of sidewalls 26. Four subunits 25 are contained in the space formed by the pair of sidewalls 26, the front beam 27, and the rear beam 29.

The four subunits 25 are located parallel to each other at intervals in the longitudinal direction. As shown in FIG. 1, a subunit for black 25K, a subunit for yellow 25Y, a subunit for magenta 25M, and a subunit for cyan 25C are located in this order from front to back. Each subunit 25 may hold the photosensitive drum 31, a charger 32, and a cleaning brush 33.

The photosensitive drum 31 may include a drum shaft 34 supported by the pair of sidewalls 26 and a drum body 35 attached to the drum shaft 34. The drum shaft 34 rotates as supported by sidewalls 26.

The charger 32 is located at an interval from the photosensitive drum 31. The charger 32 generates corona discharge to charge evenly the surface of the photosensitive drum 31. The cleaning brush 33 contacts the photosensitive drum 31.

(3-2-2) Developer Cartridge

The developer cartridge 24 includes a developer cartridge for black 24K, a developer cartridge for yellow 24Y, a developer cartridge for magenta 24M, and a developer cartridge for cyan 24C. As shown in FIG. 1, the developer cartridge for black 24K is detachably attached to a subunit for black 25K. The developer cartridge for yellow 24Y is detachably attached to a subunit for yellow 25Y. The developer cartridge for magenta 24M is detachably attached to a subunit for magenta 25M. The developer cartridge for cyan 24C is detachably attached to a subunit for cyan 25C.

Each developer cartridge 24 is attached to the subunit 25 corresponding to each developer cartridge 24 above the drum unit 23.

Each developer cartridge 24 includes a casing 36 having an aperture in the lower end. An agitator 37, a supply roller 38, a developer roller 39, and a regulating blade 40 are located in the casing 36. Toner is contained inside the casing 36. Black toner is contained in the casing 36 of the developer cartridge for black 24K. Yellow toner is contained in the casing 36 of the developer cartridge for yellow 24Y. Magenta toner is contained in the casing 36 of the developer cartridge for magenta 24M. Cyan toner is contained in the developer cartridge for cyan 24C. Each color of toner may be polymerized toner of a positively electrifiable non-magnetic single-component, and a color agent of black, yellow, magenta, and cyan are blended corresponding to each color.

The agitator 37 may be located in the upper portion in the casing 36. The agitator 37 is rotated by a driving force as provided from a motor located in the housing 2, and blends the toner in the casing 36. The supply roller 38 may be located below the agitator 37. The supply roller 38 may include a metal supply roller axis 41 rotatably supported by the casing 36, and a sponge roller 42 made of an electrically conductive sponge, which covers the supply roller axis 41. The supply roller 38 is rotated by the driving force from a motor installed in the housing 2.

The developer roller 39 includes a metal developer roller axis 43 rotatably supported by the casing 36, and a rubber roller 44 made of an electrically conductive rubber, which covers the developer roller axis 43. The developer roller 39 is located diagonally at the lower back from the supply roller 38, and the rubber roller 44 and the sponge roller 42 are pressed to be in contact with each other. The developer roller 39 is located at the position exposed from an aperture in the lower end of the casing 36. When the developer cartridge 24 is attached to the subunit 25, the developer roller 39 contacts the front of the photosensitive drum 31 on a diagonal. The developer roller 39 is rotated by the driving force from a motor installed in the housing 2.

The base end of the regulating blade 40 is supported by the casing 36 and the free end thereof extends upward toward the developer roller 39. The free end portion of the regulating blade 40 includes a press portion 45 made of an insulating silicone rubber. The press portion 45 is pressed against the rubber roller 44 of the developer roller 39.

(3-2-3) Developing Operation

In each developer cartridge 24, the toner contained in the casing 36 is supplied to the supply roller 38 due to the toner's own weight and as being blended by the agitator 37. The toner (having been supplied to the supply roller 38) is supplied to the developer roller 39 by the rotation of the supply roller 38. As the developer roller 39 rotates, the toner supplied to the developer roller 39 is conveyed between the press portion 45 of the regulating blade 40 and the developer roller 39 to form a thin film with constant thickness.

In the meantime, in the subunit 25 corresponding to each developer cartridge 24, the surface of the photosensitive drum 31 is uniformly charged by the charger 32. When the surface of the photosensitive drum 31 is exposed to the laser beam emitted from the exposure unit 17, an electrostatic latent image is formed on the surface of the photosensitive drum 31.

As the photosensitive drum 31 rotates further, the toner held on the surface of the developer roller 39 is conveyed to the electrostatic latent image formed on the surface of the photosensitive drum 31. With this transfer of toner, the electrostatic latent image becomes visible, and a toner image corresponding to each color exists on the surface of the photosensitive drum 31.

(3-3) Transfer Mechanism

As shown in FIG. 1, the transfer mechanism 19 is located above the paper feeder portion 4 and below the process unit 18 in the housing 2. The transfer mechanism 19 includes a driving roller 46, a driven roller 47, a transfer belt 48, a transfer roller 49, and a cleaning mechanism 50.

The driving roller 46 is installed at an interval from the driven roller 47 in the longitudinal direction. The driving roller 46 is located at the front of the subunit for black 25K, and the driven roller 47 is located behind the subunit for yellow 25Y.

The transfer belt 48 may be an endless belt that is formed by a resin film such as a polycarbonate or a polyimide dispersing conductive particles (e.g., carbon particles). The transfer belt 48 is conveyed between the driving roller 46 and the driven roller 47.

The driving roller 46 is rotated by driving force from a motor (not shown). Then the transfer belt 48 is conveyed between the driving roller 46 and the driven roller 47.

The transfer roller 49 is located inside of a locus of the transfer belt 48. The transfer roller 49 is located at a position corresponding to the photosensitive drum 31 for each color. The transfer belt 48 is held between the transfer roller 49 and the photosensitive drum 31. The transfer roller 49 rotates in the same direction of the moving direction of the transfer belt 48.

The cleaning mechanism 50 may be located below the transfer belt 48, and includes a first cleaning roller 51, a second cleaning roller 52, scraping blade 53, and a toner storage portion 54.

The first cleaning roller 51 contacts the outer peripheral surface of the transfer belt 48 from the lower side.

The second cleaning roller 52 contacts the first cleaning roller 51 from the lower side. The scraping blade 53 contacts the second cleaning roller 52 from the lower side.

The toner storage portion 54 is located below the first cleaning roller 51 and the second cleaning roller 52 to accumulate the excess toner as removed by the second cleaning roller 52.

The paper 3 is conveyed via the registration roller 16 from front to back by transfer belt 48. While the paper 3 is conveyed on the surface of the transfer belt 48, each color of toner image held on the photosensitive drum 31 is transferred on the paper 3 sequentially. Thus, a color image is formed on the paper 3.

First, a black toner image held on the surface of the photosensitive drum 31 of the subunit for black 25K is transferred on the paper 3. Then, a yellow toner image held on the surface of the photosensitive drum 31 of the subunit for yellow 25Y is transferred on top of it. Similarly, a magenta toner image held on the surface of the photosensitive drum 31 of the subunit for magenta 25M is transferred on top of it, and then a cyan toner image kept on the surface of the photosensitive drum 31 of the subunit for cyan 25C is transferred on top of it. As described above, a color image for each color of toner is transferred is formed on the paper 3.

After the transfer, the toner remaining on the photosensitive drum 31 is collected on the developer roller 39. After the transfer, any paper powder adhering on the photosensitive drum 31 is collected by the cleaning brush 33.

Meanwhile, the toner adhering on the surface of the transfer belt 48 is transferred to the first cleaning roller 51. The toner is then transferred from the first cleaning roller 51 to the second cleaning roller 52. The toner transferred to the second cleaning roller 52 is scraped by the scraping blade 53, falls from the second cleaning roller 52, and then collected in the toner storage portion 54.

(3-4) Fixing Unit

The fixing unit 20 is located at the back of the subunit for cyan 25C in the housing 2. The fixing unit 20 includes a heating roller 55 and a pressure roller 56.

The heating roller 55 is a metal tube with an exfoliating film on its surface. A halogen lamp is situated inside the heating roller 5. The surface of the heating roller 55 is heated by the heat that is emitted by the halogen lamp.

The pressure roller 56 is located below the heating roller 55 and pushes up against the heating roller 55 from below the heating roller 55.

The paper 3 with the color image is transferred to the fixing unit 20. While the paper 3 passes between the heating roller 55 and the pressure roller 56, the color image is fixed on the paper 3. The paper 3 with the fixed color image is conveyed to the paper ejection portion 6 by the heating roller 55 and the pressure roller 56.

(4) Paper Ejection Portion

The paper 3 from the fixing unit 20 is conveyed on a feed path 57. The upstream edge of the feed path 57 is adjacent to the fixing unit 20, and the downstream edge thereof is adjacent to a paper catch tray 58 formed on the top surface of the housing 2.

In the middle of the feed path 57, a transfer roller 59 and a pinch roller 60 face each other. A pair of paper ejection rollers 61 is located at the downstream edge of the feed path 57.

The paper 3 is conveyed on the feed path 57 by the transfer roller 59 and the pinch roller 60, and is ejected on the catch tray 58 by the paper ejecting rollers 61.

2. Casing of Developer Cartridge

Figure 3:
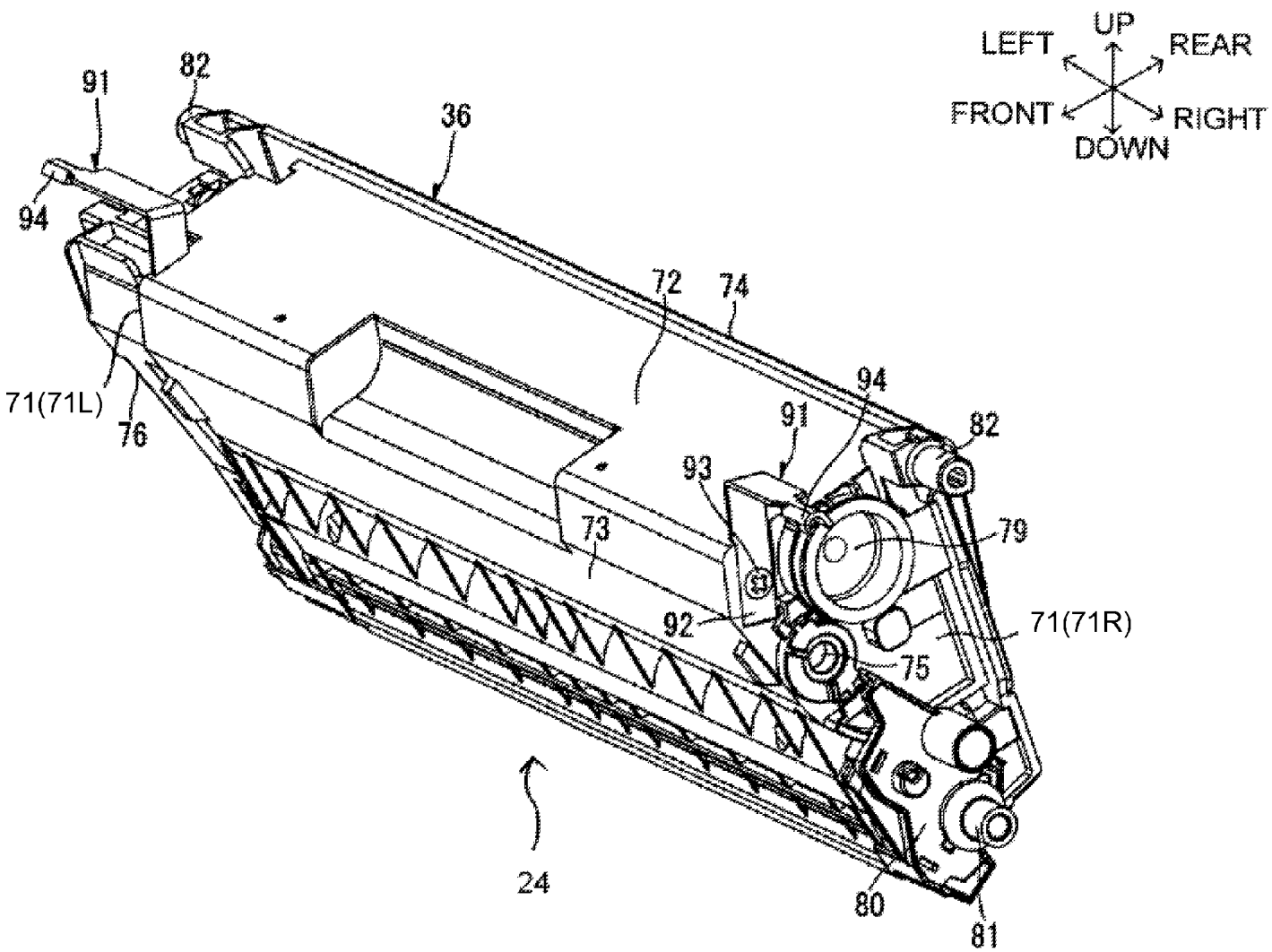
FIG. 3 represents a perspective view of the developer cartridge represented in FIG. 1 in accordance with aspects of the present invention.
Figure 4:
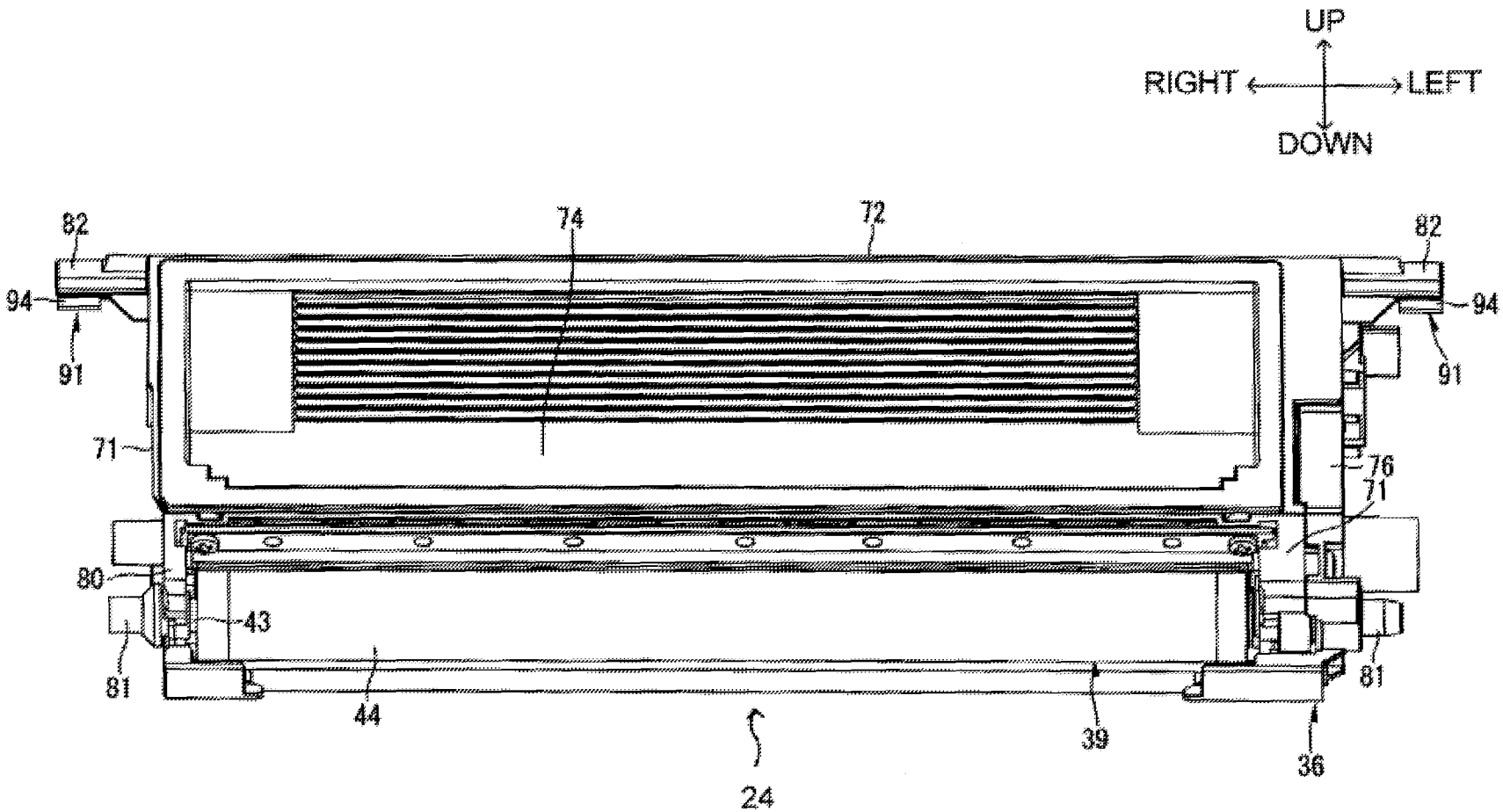
FIG. 4 represents a rear view of the developer cartridge represented in FIG. 3 in accordance with aspects of the present invention.
Figure 5:
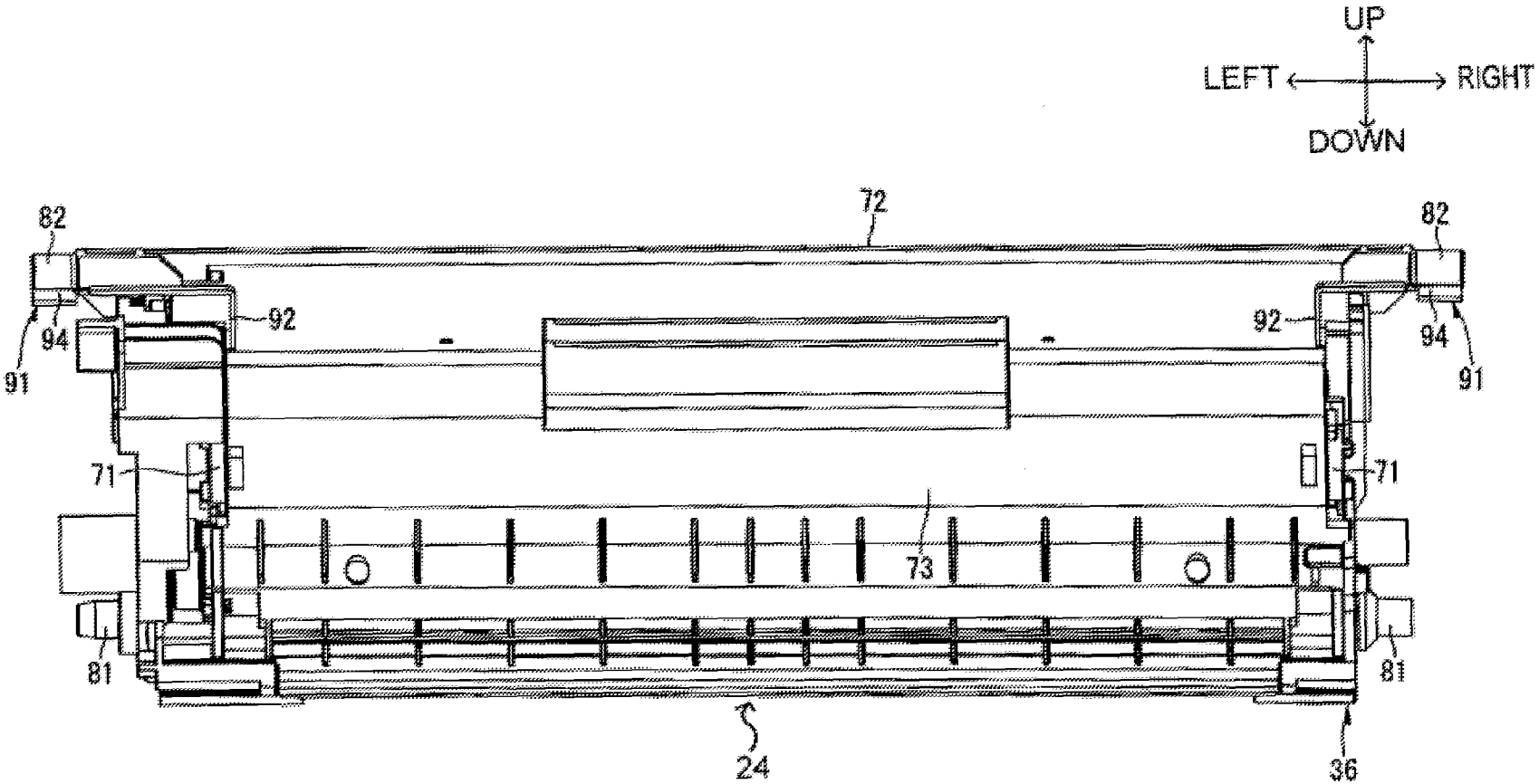
FIG. 5 represents a front view of the developer cartridge represented in FIG. 3 in accordance with aspects of the present invention.

As shown in FIG. 3, the casing 36 of the developer cartridge 24 has a left sidewall 71L and a right sidewall 71R facing the left sidewall 71L. An upper wall 72 is located between the upper edge of the sidewall 71L and the upper edge of the sidewall 71R. A front wall 73 is located at between the front edge of the sidewall 71 L and the front edge of the sidewall 71 R. A back wall 74 is located between the back edge of the sidewall 71L and the back edge of the sidewall 71R. The sidewall 71L, the sidewall 71R, the upper wall 72, the front wall 73 and the back wall 74 are formed integrally with a resin. The lower end of the casing 36 is open, and the developer roller 39 is exposed from the opening portion.

A window 75 is located in the sidewall 71L and the sidewall 71R respectively. The windows 75 are formed facing each other, such that light can pass through a first if the windows 75 and exit the other of the windows 75. The amount of remaining toner in the casing 36 can be detected by the light passing through windows 75.

Figure 7:
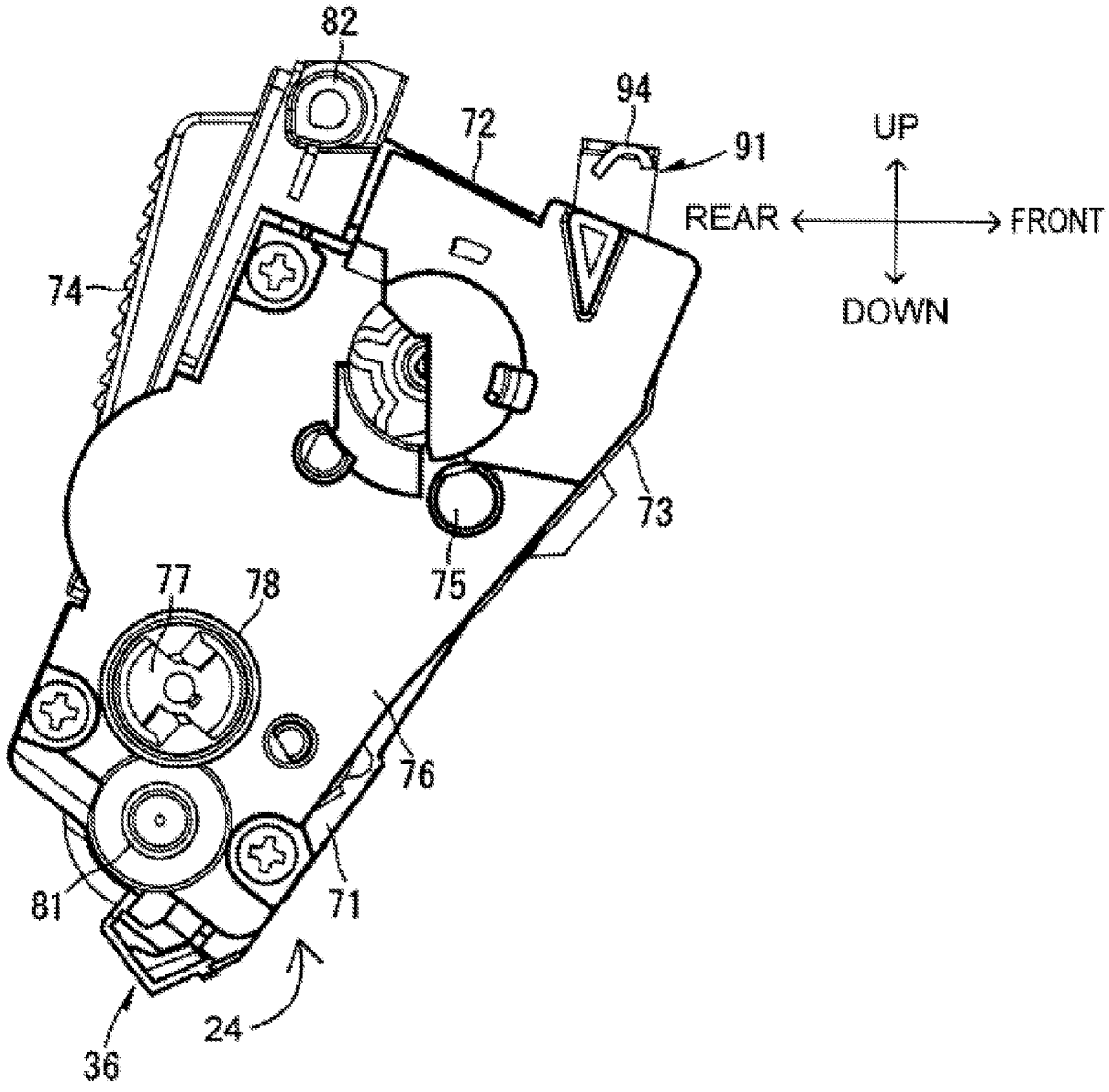
FIG. 7 represents a left side view of the developer cartridge represented in FIG. 3 in accordance with aspects of the present invention.

As shown in FIG. 7, a gear mechanical portion, which is covered by a gear cover 76, is located on the left sidewall 71L. The gear mechanical portion includes a coupling gear 77 exposed from the gear cover 76, and a gear train for transmitting driving force applied to the coupling gear 77.

A gear arranging portion 78 is formed protruding at the lower-edge portion of the gear cover 76. The coupling gear 77 is situated in the gear arranging portion 78 and is exposed from the front edge surface of the gear arranging portion 78. A coupling axis installed in the housing 2 is connected to the coupling gear 77. The driving force of a motor installed in the housing 2 is applied to the coupling gear from the coupling axis.

The gear train includes an agitator gear fixed to the rotation axis of the agitator 37, a supply roller gear fixed to the supply roller axis 41 of the supply roller 38, a developer roller gear fixed to the developer roller 39 of the developer roller axis 43, and so on. The driving force applied to the coupling gear 77 is transmitted to the agitator 37, the supply roller 38, and the developer roller 39 via the gear train.

Figure 6:
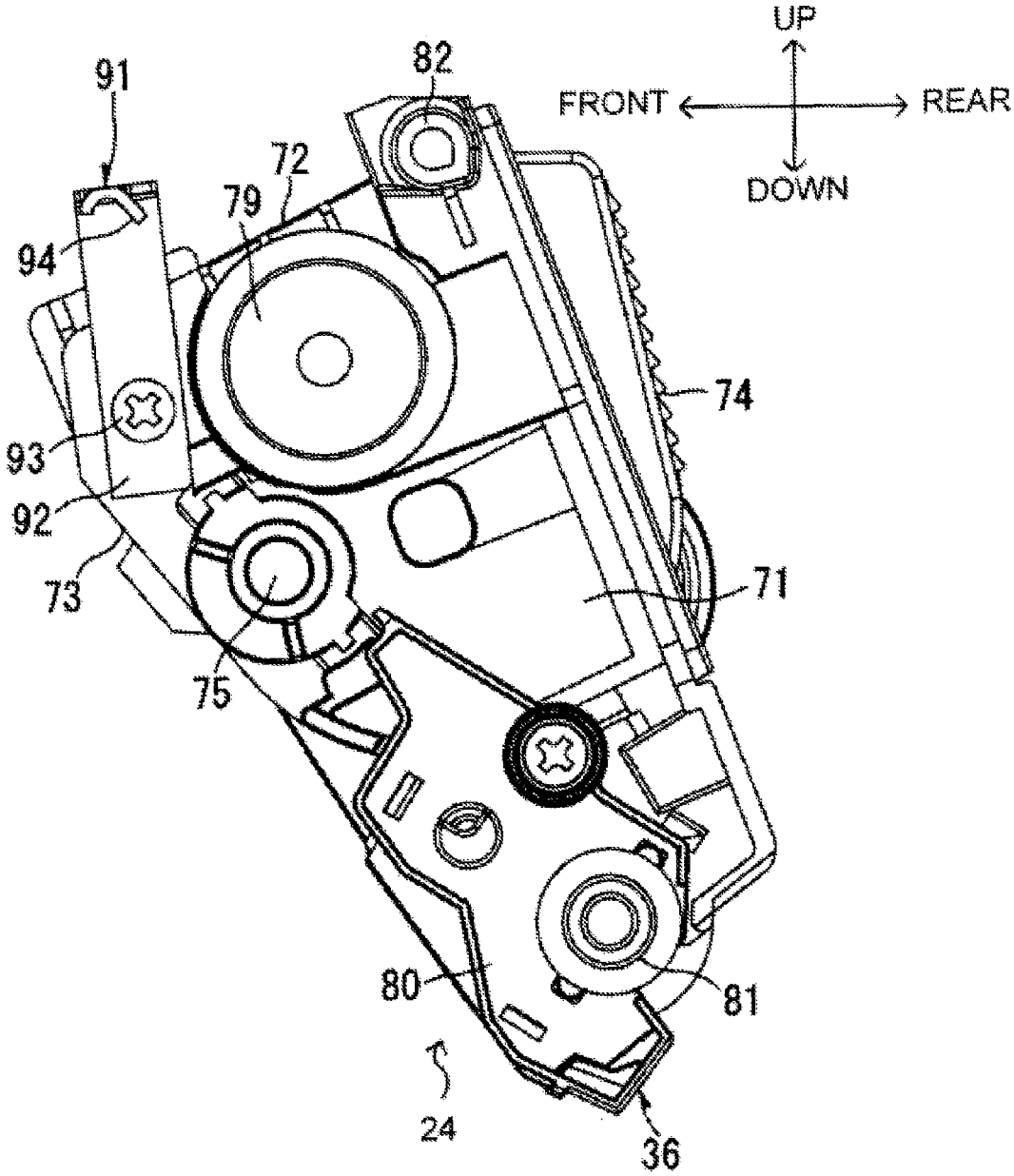
FIG. 6 represents a right side view of the developer cartridge represented in FIG. 3 in accordance with aspects of the present invention.

As shown in FIG. 3 and FIG. 6, a toner fill port is formed obliquely upward of the window 75 in the right sidewall 71R. A cap 79 is used to close the toner fill port.

A bearing member 80, which rotatably supports the edge of the developer roller axis 43, is located at the lower-edge portion of the right sidewall 71R. Both edges of the developer roller axis 43 protrude from the gear cover 76 and the bearing member 80 respectively, and the protruded portions are covered with collars 81.

As shown in FIG. 3 to FIG. 7, an almost-cylindrically shaped first protrusion 82 is formed at the upper-edge portions of the sidewall 71L and sidewall 71R. The first protrusion 82 protrudes horizontally outward from the portion connected with the upper-edge portion of the back wall 74. In addition, in the upper-edge portion of the sidewall 71L and the sidewall 71R, elastic members 91 are installed near the first protrusion 82 at the portion connected with the front wall 73.

The elastic members 91 are formed, for example, by processing a flat spring. One end of the elastic member 91 is a fixed portion 92. The fixed portion 92 is fixed on the outside of sidewall 71 by a screw 93. The elastic member 91 extends upward from the fixed portion 92, and is bent and extended horizontally outward at the upper position from the upper wall 72. Another edge of the elastic member 91 is a second protrusion 94. The second protrusion 94 horizontally protrudes outward from the sidewall 71, and the front-edge portion is bent to be almost a semi-circle from a side view.

3. Estrangement and Mechanism of Pressing

Figure 8:
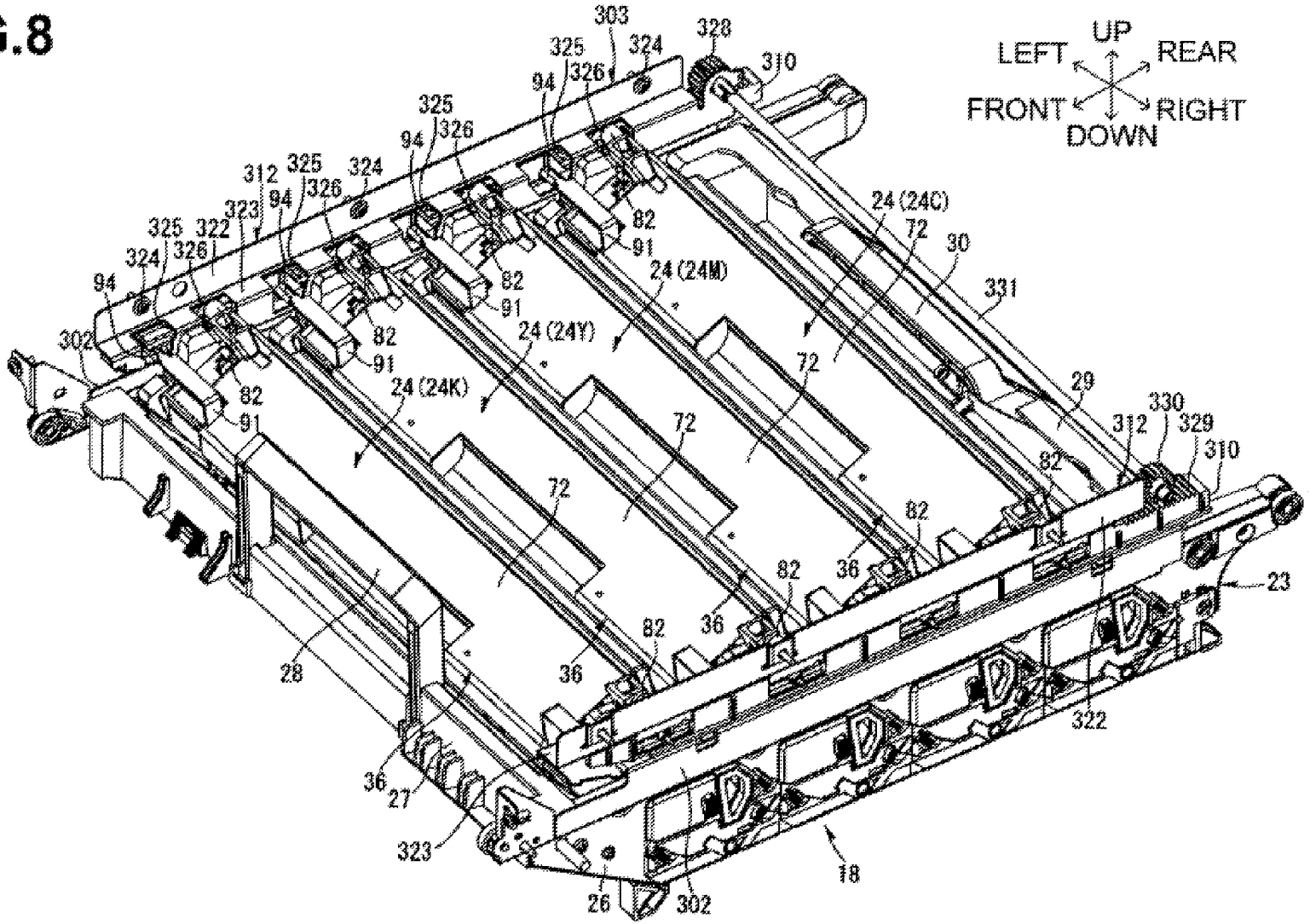
FIG. 8 represents a perspective view of a drum unit, a right and a left rails, and a separation and press mechanism in accordance with aspects of the present invention.
Figure 9:
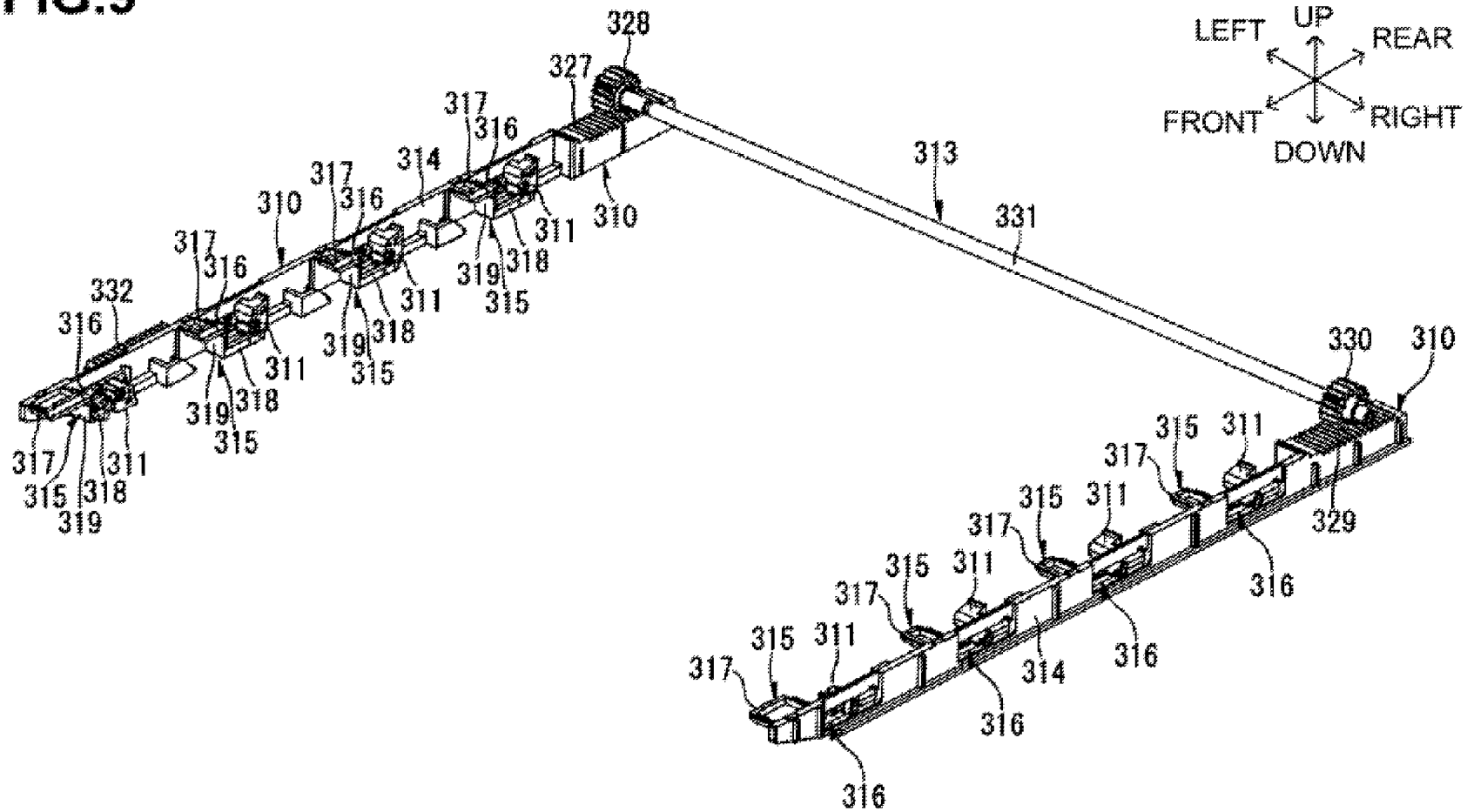
FIG. 9 represents a perspective view of the separation and press mechanism represented in FIG. 8 in accordance with aspects of the present invention.

In the housing 2, two frames face each other across the drum unit 23. As shown in FIGS. 8 and 9, a rail 302 and a separation press mechanism 303 are installed on the inner surface of each frame. The rail 302 guides the attachment and detachment of drum unit 23. The separation press mechanism 303 acts on the developer cartridge 24 to press the developer roller 39 toward the photosensitive drum 31 and separate the developer roller 39 from the photosensitive drum 31.

The rails 302 face each other across the drum unit 23. The rail 302 extends in the longitudinal direction.

The separation press mechanism 303 is installed above the rail 302. As shown in FIG. 8 and FIG. 9, the separation press mechanism 303 includes a pair of translation cam members 310, intermediate members 311, which are installed to correspond to each translation cam members 310, cam holders 312, which support each of the translation cam members 310 moving linearly in the longitudinal direction, and a synchronizing transfer mechanism 313, which synchronizes and moves the pair of translation cam members 310 linearly.

In FIG. 9, illustration of the cam holder 312 is omitted.

As shown in FIG. 9 to FIG. 13, the translation cam member 310 includes a thin plate shaped cam body plate 314, which extends in the longitudinal direction, and four operating members 315 installed in the horizontal internal surface of the cam body plate 314.

In the cam body plate 314, four rectangular slots 316, which is longer horizontally than vertically are formed at even intervals in the longitudinal direction.

Four operating members 315 are installed at the front side of four rectangular slots 316 respectively. Each operating member 315 includes a press acting portion 317, a contact and separation acting portion 318, and a connecting portion 319. The press acting portion 317 is formed in crank shape as seen from the side, extends along the upper edge of the cam main body plate 314, and presses the second protrusion 94 of the developer cartridge 24 downward.

The contact and separation acting portion 318 extends along the lower edge of the cam main body plate 314 and rotates the intermediate members 311. The connecting portion 319 connects the back-edge portion of the press acting portion 317 with the front-edge portion of the contact and separation acting portion 318.

Figure 11:
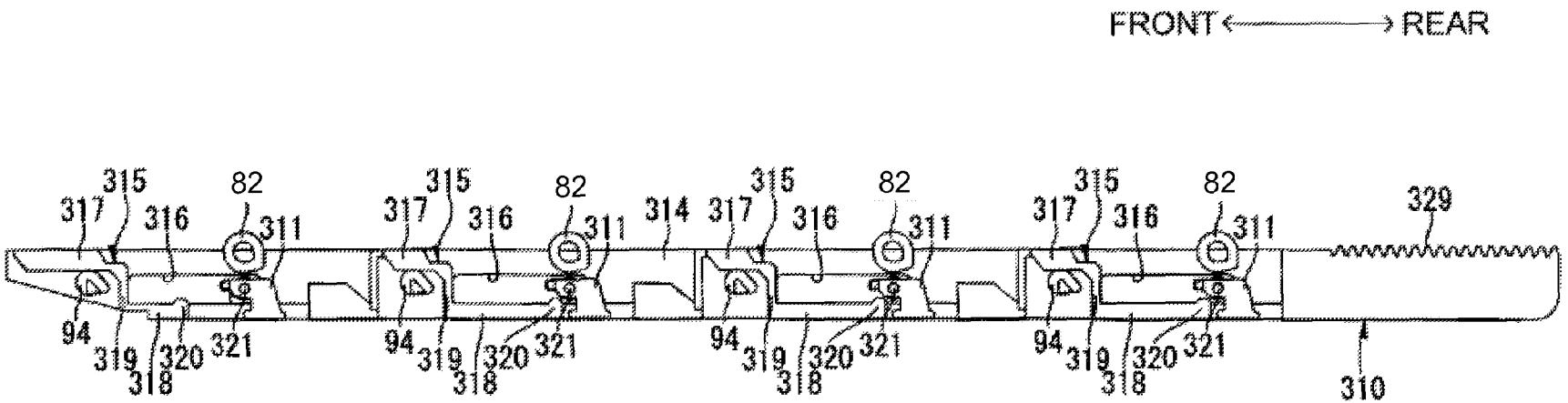
FIG. 11 represents a right side view of the translation cam material and the intermediate member in a state of FIG. 10A in accordance with aspects of the present invention.
Figure 12:
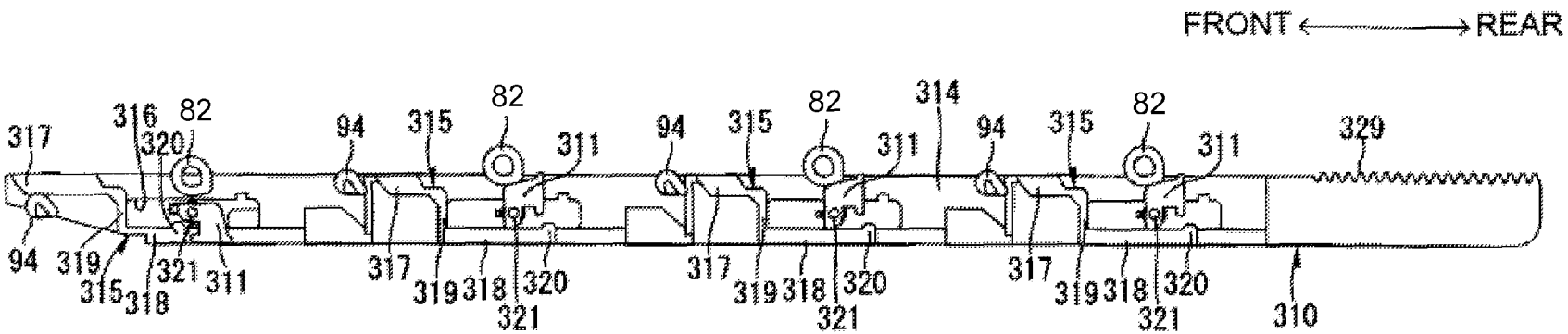
FIG. 12 represents a right side view of the translation cam material and the intermediate member in a state of FIG. 10C in accordance with aspects of the present invention.
Figure 13:
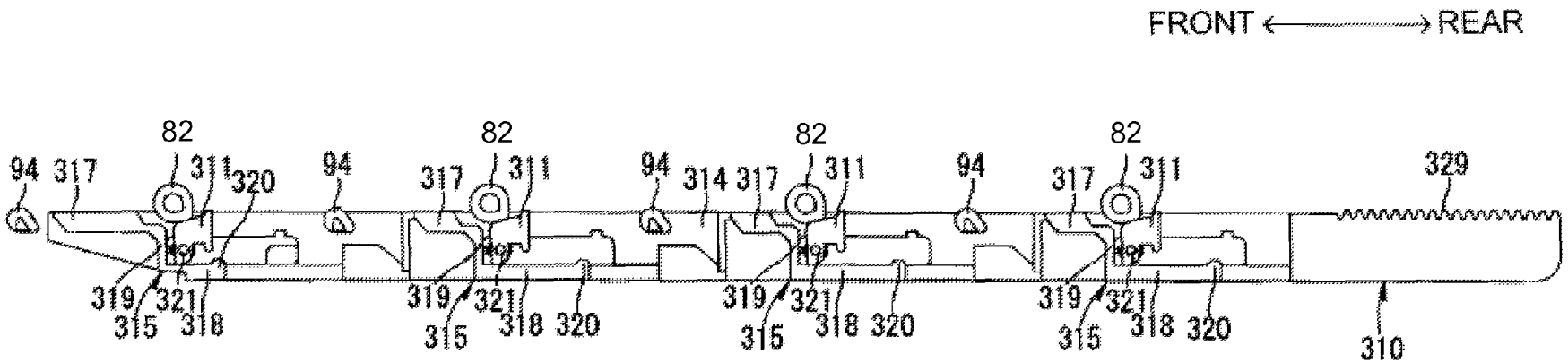
FIG. 13 represents a right side view of the translation cam material and the intermediate member in a state of FIG. 10E in accordance with aspects of the present invention.

As shown in FIG. 11 to FIG. 13, a protruding portion 320 (protruding upward) is formed on the back-edge portion of the contact and separation acting portion 318.

In addition, the shape of the operating member 315 nearer the front of the color laser printer 1 is different from the other three operating members 315 (hereafter, referred to as "three rear operating members 315"). That is, the front (that is, nearer the front of color laser printer 1) of press acting portion 317 of the operating portion 315 is longer than that of the press acting portion 317 of the three rear operating members 315 in the longitudinal direction. In addition, the front contact and separation acting portion 318 of the operating member 315 is shorter than that of the contact and separation acting portion 318 of the three rear operating members 315 in the longitudinal direction. As described below, the difference of this shape is permits the following states:

1. The state that the photosensitive drum 31 is pressed by all of the developer rollers 39 of the developer cartridges 24 (as shown in FIG. 11).
2. The state that the photosensitive drum 31 is pressed by only the developer roller 39 of the developer cartridge for black 24K (as shown in FIG. 12).
3. The state that the photosensitive drum 31 is separated from all of the developer rollers 39 of the developer cartridges 24 (as shown in FIG. 13).

Four intermediate members 311 are installed at the back of each of the four operating members 315. Four intermediate members 311 face four rectangular slots 316 in the horizontal direction respectively. As shown in FIG. 11 to FIG. 13, each intermediate member 311 is almost L-shaped as seen from the side, and is formed in a block shape having thickness in the horizontal direction.

A supporting axis 321 penetrates one end of the intermediate member 311 in the horizontal direction. The intermediate member 311 is supported by the supporting axis 321 and is rotatable about the supporting axis 321. In the state that each intermediate member 311 does not contact the contact and separation acting portion 318. As shown in FIG. 11, the lower-edge portion of the intermediate member 311 is spaced in the longitudinal direction from the protruding portion 320 of the contact and separation acting portion 318.

As shown in FIG. 10, the supporting axes 321 are located at even intervals to each other in the longitudinal direction. The interval spacing is equal to the interval between the first protrusion 82 of each developer cartridge 24 in the state that the four developer cartridges 24 are attached on the drum unit 23. The supporting axis 321 passes through the corresponding rectangular slot 316. The outer edge of the supporting axis 321 extends outward in the horizontal direction from the cam body plate 314, the inner edge is fixed on the cam holder 312, and the supporting axis 321 is non-rotatable.

As shown in FIG. 8, the cam holder 312 includes a thin plate holder fixing portion 322 extending in the longitudinal direction, and a continuous cam storage part 323 at the lower edge of the fixing portion 322.

The holder fixing portion 322 is fixed by a screw 324 to the inner surface of the frame in the housing 2.

The cam storage portion 323 extends inwardly in the horizontal direction along the full length of the lower edge of the holder fixing portion 322, is bent downward and further bent outward in the horizontal direction, thereby forming an approximate U-shape in cross-section. Four second receiving portions 325 and four first receiving portions 326 are alternately formed on the top surface of the cam storage portion 323.

The second receiving portion 325 is a notch, which is formed continuously from the top surface to the internal surface of the cam storage surface 323, and can receive the second protrusion 94 of the developer cartridge 24.

The first receiving portion 326 is a notch, which is formed continuously from the top surface to the internal surface of the cam storage surface 323, and can receive the first protrusion 82 supported by the developer cartridge 24.

Therefore, in the state that each developer cartridge 24 is located in the drum unit 23, each interval of four second receiving portions 325 formed in the cam storage portion 323 is equal to the interval between the second protrusions 94 in the longitudinal direction. Each interval of the four first receiving portions 326 is equal to the interval between the first protrusions 82 in the longitudinal direction.

The first receiving portion 326 is located behind the second receiving portion 325. In the state that the first protrusion 82 is received in the first receiving portion 326, the first protrusion 82 faces the intermediate member 311 from above the intermediate member 311.

The synchronizing transfer mechanism 313 transmits a driving force from the left translation cam member 310 to the right translation cam member 310 as the left translation cam member 310 moves linearly.

As shown in FIG. 9, the synchronizing transfer mechanism 313 includes a left rack gear 327, a left pinion gear 328, a right rack gear 329, a right pinion gear 330, and a connecting shaft 331. The left rack gear 327 is formed on the back-edge portion of the top surface of the left translation cam member 31 0. The left pinion gear 328 fits with the left rack gear 327. The right rack gear 329 is formed on the back-edge portion of the top surface of the right translation cam member 310. The right pinion gear 330 fits with the right rack gear 329. The left pinion gear 328 and the right pinion gear 330 are attached on the connecting shaft 331.

In addition, an input rack gear 332 that the driving force from a motor is applied is installed on the left translation cam member 310.

4. Separation Press Mechanism

The operation of the separation press mechanism 303 will be explained with reference to FIG. 10 (FIG. 10A through FIG. 10E) to FIG. 13.

Figures 10A, 10B, 10C, 10D, 10E:
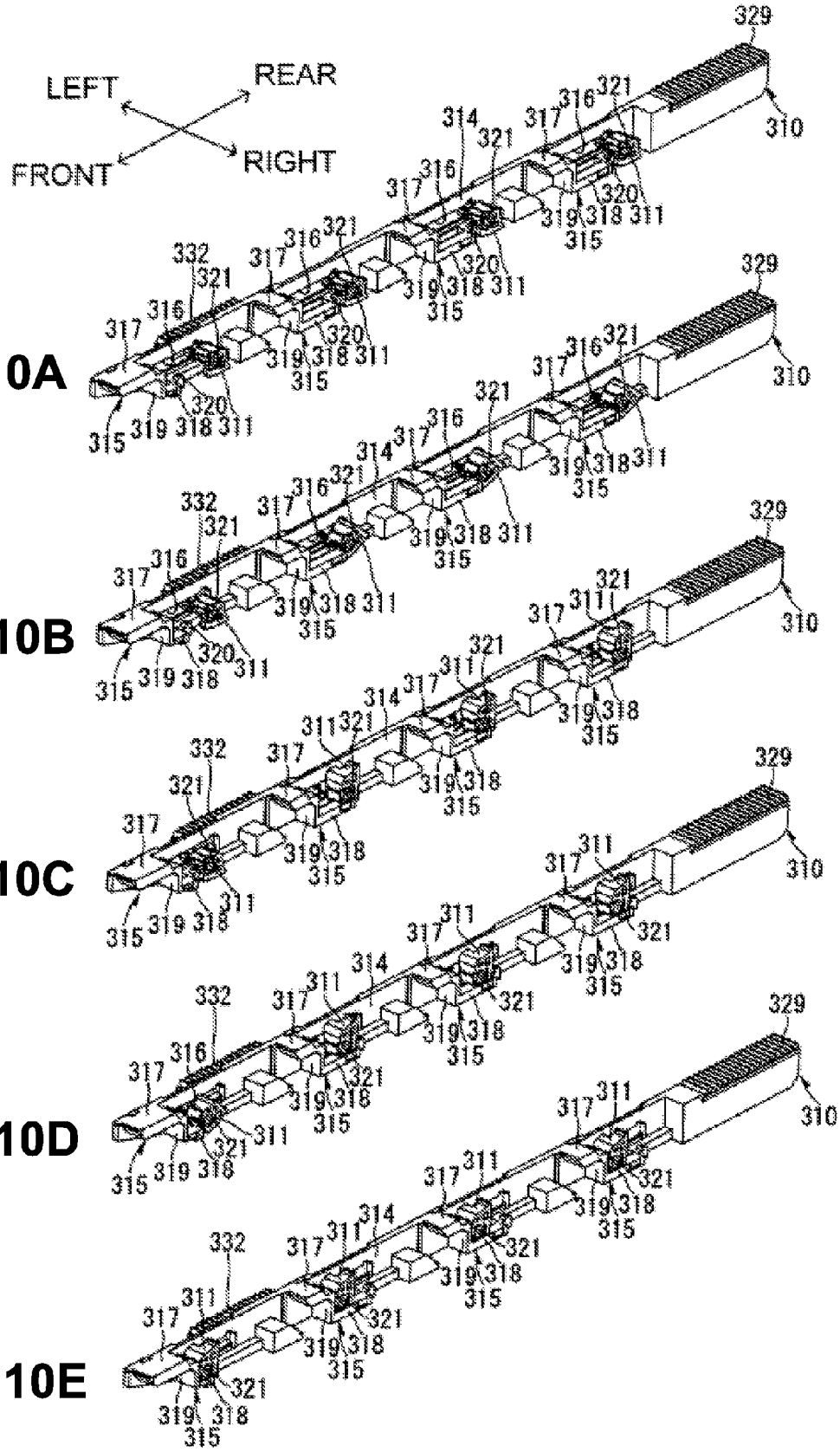
FIG. 10A to FIG. 10E represent a perspective view of a translation cam and an intermediate member represented in FIG. 9, representing each state during the separation and the press operation with the separation and press mechanism respectively in accordance with aspects of the present invention.

As shown in FIG. 10A and FIG. 11, in the state that the translation cam member 310 is moved to the foremost position, the contact and separation acting portion 318 and the intermediate member 311 face each other with a spacing interval in the longitudinal direction. The spacing interval between the foremost contact and separation acting portion 318 and the intermediate member 311 is larger than that between the three of rear contact and separation acting portions 318 and the intermediate members 311.

In this state, as shown in FIG. 11, the press acting portion 317 abuts on the second protrusion 94 from above and presses downward on the second protrusion 94. The second protrusion 94 is elastically deformed by being pressed downward. A restoring force acts on the second protrusion 94 and the restoring force is transmitted to the sidewall 71 via the fixed portion 92. Thus, the casing 36 is urged downward and the photosensitive drum 31 is pressed against the developer roller 39. In this state, since all of the four developer cartridges 24 are urged downward, all four toner colors may be used to make an image (namely, a full color image).

When driving force is input into the input rack gear 332 in this state, the left translation cam member 310 moves rearward. As the left translation cam member 310 moves, the left pinion gear 328 revolves. The revolution of the left pinion gear 328 is transmitted to the right pinion gear 330 via the connecting shaft 331. The right pinion gear 330 revolves in same direction as the left pinion gear 328, hence, the translation cam member 310 moves rearward.

When the translation cam member 310 moves backward, the engagement between each of the three rear press acting portions 317 and the second protrusions 94 are released.

Then the pressing force on the second protrusion 94 by the press acting portion 317 is released. As shown in FIG. 10B, the three rear contact and separation acting portions 318 abut the lower-edge portion of the intermediate member 311 to press downward at the lower-edge portion of the intermediate member 311. Then the intermediate member 311 revolves to be lifted upward at the supporting axis 321 as a fulcrum. During the revolution of the intermediate member 311, the intermediate member 311 abuts the first protrusion 82 from below. The intermediate member 311 applies an upward force to the first protrusion 82. Thereby, the developer cartridge for yellow 24Y, developer the cartridge for magenta 24M, and the developer cartridge for cyan 24C are lifted upward.

When the translation cam member 310 moves further backward, as shown in FIG. 10C and FIG. 12, one end of the intermediate members 311 abut the three of rear contact and separation acting portions 318. Thereby, each of the developer rollers 39 of the developer cartridge for yellow 24Y, developer the cartridge for magenta 24M, and the developer cartridge for cyan 24C are separated from the photosensitive drum 31. At this time, the second protrusion 94 of the developer cartridge for black 24K is pressed by the press acting portion 317. That is, only the developer roller 39 of the developer cartridge for black 24K is pressed on the photosensitive drum 31. In this state, a black and white (monochrome) printing is performed while not forcing the developer rollers 39 for color toner to be pressed against the photosensitive drums 39 (corresponding to the color toner).

When the translation cam member 310 further moves backward, the engagement between the foremost press acting portion 317 and the second protrusion 94 of the developer cartridge for black 24K is released. Thereby, the pressure on the second protrusion 94 by the press acting portion 317 is released. In addition, as shown in FIG. 10D, the foremost contact and separation acting portion 318 abuts the lower-edge portion of the intermediate member 311 to press downward at the lower-edge portion of the intermediate member 311. Then the intermediate member 311 revolves to be lifted upward at the supporting axis 321 as a fulcrum. During the revolution of the intermediate member 311, the intermediate member 311 abuts the first protrusion 82 of the developer cartridge for black 24K from below. The intermediate member 311 applies an upward force to the first protrusion 82. Thereby, the developer cartridge for black 24K is lifted upward.

When the translation cam member 310 moves further backward, as shown in FIG. 10E and FIG. 13, one end of the intermediate member 311 abuts on the foremost contact and separation acting portions 318, thereby, the developer roller 39 of the developer cartridge for black 24K are separated from the photosensitive drum 31. Thus, all of the developer rollers 39 of the developer cartridges 24 are separated from the photosensitive drum 31.

When the translation cam member 310 moves forward from the state shown in the FIG. 10E, it can move back to the states shown in FIG. 10A to FIG. 10D. The protruding portion 320 of the contact and separation acting portion 318 is locked on the intermediate member 311 to revolve downward about the intermediate member 311. The intermediate member 311 is separated from the first protrusion 82.

Figure 14:
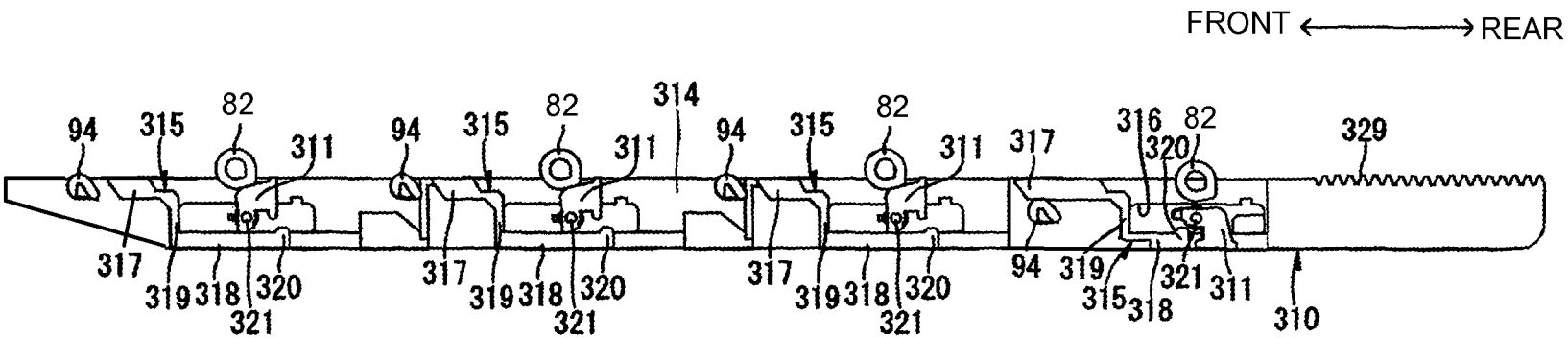
FIG. 14 represents a right side view of the of the translation cam material and the intermediate member in a state in which one of the cartridges is pressed against a photosensitive drum while the other cartridges are not pressed against photosensitive drums in accordance with aspects of the present invention.

FIG. 14 shows an alternative arrangement of the developer cartridges 24 (24K, 24Y, 24M, 24C) in which the order of the developer cartridges are 24Y, 24M, 24C, and 24K in order as the direction of paper 3. FIG. 14 shows the relationships of the first protrusions 82 and second protrusions 94 moving in relation to each other based on this alternative arrangement of developer cartridges 24. In particular, second protrusion 94 of the rear most cartridge in FIG. 14 is forced down by press action portion 317. The second protrusions 94 of the other cartridges are not pressed down by the corresponding press action portions 317. Here, FIG. 14 shows the cartridges 24 in an arrangement where monochrome printing (using cartridge 24K) is enabled as the remaining cartridges (for example, 24Y, 24M, and 24C) are not pressed down.

The structural arrangement as shown in FIG. 14 may replace the structural arrangements as shown FIGS. 8-13. This permits cartridge 24K to be placed as the last cartridge in line of the path of paper 3. In this arrangement, toner from the black cartridge may be the last toner applied and, thereby, be prevented from accumulating on photosensitive drums 31 and/or developer rollers 39.

5. Effects of Action

As described above, since the elastic member 91 is installed in the developer cartridge 24, the elastic member 91 will be new whenever the developer cartridge 24 is replaced. Therefore, the urging force of the elastic member 91 is always consistent, and a proper pressing state of the developer roller 39 on the photosensitive drum 31 can be maintained. Thus, the amount of toner supplied from the developer roller 39 to the photosensitive drum 31 is constantly stable. Thereby, a picture of high quality can be formed continuously without producing poor development (from less than adequate conveyance of toner from the developer roller 31 to the photosensitive drum 39.

In addition, since the elastic member 91 is fixed on the sidewall 71L by the screw 93, when specifications of toner or the developer roller 39 are changed, the elastic member 91 having the proper elasticity appropriate for the new specifications can be used. Therefore, the pressing force of the developer roller 39 on the photosensitive drum 31 is suitably maintained, thereby, supply of toner from the developer roller 39 to the photosensitive drum 31 can be improved. Thus, the amount of toner supplied from the developer roller 39 to the photosensitive drum 31 is constantly stable, thereby, a picture of high quality can be formed continuously without poor conveyance of developer from the developer roller 39 to the photosensitive drum 31.

In addition, the fixed portion 92 of the elastic member 91 is fixed on the sidewall 71 of the developer cartridge 24, and the second protrusion 94 is positioned to protrude outward in horizontal direction. Therefore, it is easy to find a place in the housing 2 to install the separation press mechanism 303 for applying pressing force on the second protrusion 94. Furthermore, the pressing force from the separation press mechanism 303 is reliably applied on the second protrusion 94.

The second protrusion 94 is elastically deformed because the elastic member 91 is made from a metal flat spring. The restoring force caused by the elastic deformation acts as the force that presses the developer roller 39 to the photosensitive drum 31. Therefore, the force of pressing the developer roller 39 on the photosensitive drum 31 can be obtained with a simple structure.

The elastic member 91 is located on the sidewalls 71L, 71R in the horizontal direction of the casing 36 of the developer cartridge 24 respectively. Thereby, the developer roller 39 can be pressed on the photosensitive drum 31 in a balanced manner. Therefore, the amount of toner supplied from the developer roller 39 can be uniform in the axial direction of the photosensitive drum 31. Thus, an electrostatic latent image can be clearly visualized.

What is claimed is:

1. An image forming apparatus comprising:

a housing;

an image carrier cartridge detachably installed in the housing, the image carrier cartridge including an image carrier; and a developer cartridge detachably installed in the image carrier cartridge, wherein the developer cartridge includes:

a casing that accommodates developer therein, the casing including a pair of sidewalls, each facing each other in a first direction;

a developer carrier including a developer carrier shaft, the developer carrier shaft being supported by the casing so as to extend between the pair of the side walls in the first direction, the developer carrier holding the developer thereon; and an urging member provided in each of the pair of sidewalls, the urging member including a fixed portion fixed on each of the pair of sidewalls and a projecting portion projected outward from each of the pair of sidewalls in the first direction.

2. An image forming apparatus according to claim 1, wherein the projecting portion is formed to have elasticity.

3. An image forming apparatus according to claim 2, wherein the urging member is a plate spring.

4. An image forming apparatus according to claim 1, further comprising:

a pair of press mechanisms for applying pressure on the projecting portion.

5. An image forming apparatus according to claim 1, further comprising:

three additional developer carriers; and three additional image carriers, where a first of the developer carriers is pressed against a first of the image carriers in both monochrome and color printing modes and where the second through fourth developer carriers are pressed against the second through fourth image carriers only in said color printing mode.

6. A developer cartridge comprising:

a casing that accommodates developer therein, the casing including a pair of sidewalls, each facing each other in a first direction;

a developer carrier including a developer carrier shaft, the developer carrier shaft being supported by the casing so as to extend between the pair of the sidewalls in the first direction, the developer carrier holding the developer thereon; and an urging member provided in each of the pair of sidewalls, the urging member including a fixed portion fixed on each of the pair of sidewalls and a projecting portion projecting outward from each of the pair of sidewalls in the first direction.

7. A developer cartridge according to claim 6, wherein the projecting portion is formed to have elasticity.

8. A developer cartridge according to claim 7, wherein the urging member is a plate spring.

* * * * *